United States Patent [19]

Thomas et al.

[11] Patent Number: 4,605,587

[45] Date of Patent: Aug. 12, 1986

[54] FLUOROCHEMICAL COMPOSITION FOR COATING SOIL RESISTANT YARN

[75] Inventors: Robert H. Thomas, Columbia, S.C.; Willis B. Hammond, Chatham, N.J.; Michael P. Friedberger; William A. Archie, both of Petersburg, Va.

[73] Assignee: Allied Corporation, Morris Township, Morris County, N.J.

[21] Appl. No.: 350,544

[22] Filed: Feb. 19, 1982

[51] Int. Cl.[4] ..... B32B 7/00; C07C 69/76; D06M 13/34

[52] U.S. Cl. ..... 428/265; 252/8.6; 252/8.8; 427/393.4; 428/267; 428/361; 428/362; 428/365; 560/87

[58] Field of Search ..... 560/87; 252/8.8, 8.6; 427/393.4; 428/361, 362, 365, 267, 265

[56] References Cited

U.S. PATENT DOCUMENTS

| | | | |
|---|---|---|---|
| 4,192,754 | 3/1980 | Marshall et al. | 252/8.8 |
| 4,193,880 | 3/1980 | Marshall | 252/8.8 |
| 4,209,610 | 6/1980 | Mares et al. | 427/212 X |
| 4,219,625 | 8/1980 | Mares et al. | 560/87 X |
| 4,264,484 | 4/1981 | Patel | 427/393.4 X |
| 4,329,489 | 5/1982 | Saunders et al. | 560/79 |
| 4,346,141 | 8/1982 | Remington | 427/393.4 X |

*Primary Examiner*—Thurman K. Page
*Attorney, Agent, or Firm*—Richard A. Anderson

[57] ABSTRACT

Improved retention on yarn and processing properties have been discovered in a composition of matter comprising meta and para pyromellitates

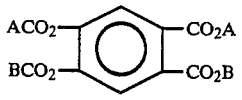

I.

and

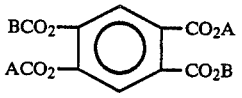

II.

and 2 to 50 percent by weight of specific dimers of I. and II., wherein A is $(CH_2)_2(CF_2)_nCF_3$, where n is 5 to 13 and B is $CH_2CHOHCH_2Cl$.

17 Claims, No Drawings

FLUOROCHEMICAL COMPOSITION FOR COATING SOIL RESISTANT YARN

BACKGROUND OF THE INVENTION

This invention relates to a new composition of matter, namely a pyromellitate fluorocarbon monomer containing up to 50 percent of its dimer. The new composition is useful in or on fiber to reduce soiling of fabric constructed of the fiber such as carpet, and will remain on fabric after normal wear and repeated washing.

It is known to use the monomer mixture of fluorocarbon meta and para pyromellitates in a yarn finish for nylon and polyester fiber for use in fabric, such as carpet, in U.S. Pat. No. 4,192,754 hereby incorporated by reference. This fluorocarbon is also disclosed in U.S. Pat. No. 4,209,610, hereby incorporated by reference. An improved process to manufacture this fluorocarbon pyromellitate is disclosed in U.S. Pat. No. 4,329,489, also hereby incorporated by reference.

It is suspected that the previously known fluorocarbon pyromellitate monomer inherently contained very small amounts (less than 1 percent) of dimer, considered impurities, which occurred naturally during its manufacture. However, a change in the manufacturing process by a supplier of the fluorocarbon pyromellitate produced a product which in use in finish on nylon fiber for carpets suddenly had different properties, discovered by the inventors. The inventors also analyzed the fluorocarbon pyromellitate and the yarn to discover its composition and the surprising properties of yarn having a finish containing the inventive composition.

SUMMARY OF THE INVENTION

This invention is a composition of matter comprising 98 to 50 percent by weight of fluorocarbon compounds of a mixture of meta and para pyromellitates having the structure

I.

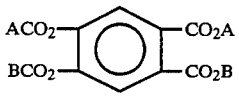

and

II.

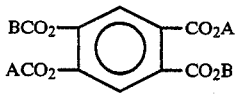

and 2 to 50 percent by weight of fluorocarbon compounds of a dimer of the same pyromellitates selected from the group consisting of

III.

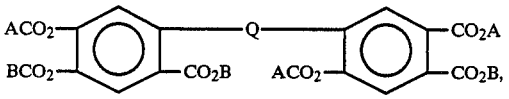

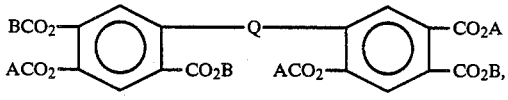

-continued

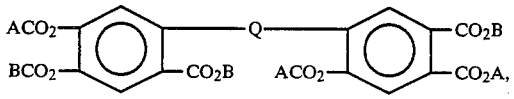

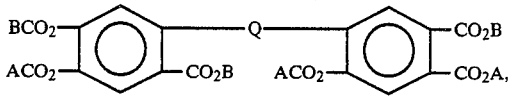

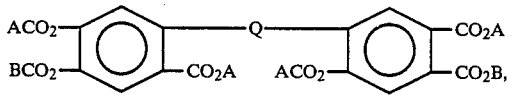

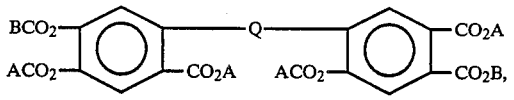

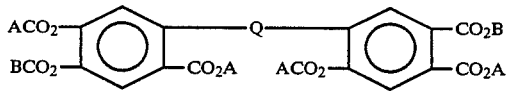

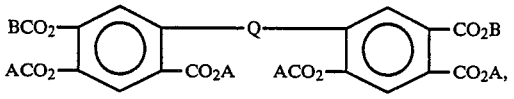

and mixtures thereof, wherein Q is

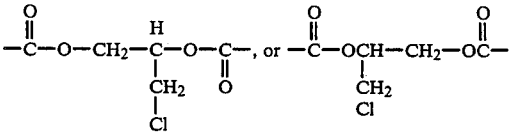

wherein A is $(CH_2)_2(CF_2)_nCF_3$ where n is 5 to 13 and B is $CH_2CHOHCH_2Cl$, and/or

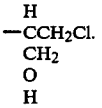

This composition can be emulsified to be incorporated into a finish which can be used as a spin finish or other type finish to coat yarn. The preferred yarn is nylon or polyester. The preferred composition is 5 to 40 percent of the dimers labelled "III" and even more preferred is 10 to 30 percent of the dimers labelled "III".

This invention is also a yarn finish composition comprising (a) about 15 to 80 percent by weight of a solution of a salt of dioctylsulfosuccinate, propylene glycol and water, and (b) the composition described above by "I", "II", and "III". Component (a) above is the preferred emulsifier and is taught in U.S. Pat. No. 4,192,754. However, a yarn finish could also be applied containing only the composition above without previously emulsifying it, as in a solvent based finish. Also, the yarn could contain a small amount of the composition of this invention in the fiber polymer as in a melt blend of the composition described above.

DESCRIPTION OF THE PREFERRED EMBODIMENT

Beginning in September, 1981, batches of the fluorocarbon pyromellitate from one supplier appeared to have different characteristics, including better oil repellency, better retention on fiber, different crimping characteristics during processing of yarn to staple nylon 6 fiber, and better direct cabling for continuous filament yarn.

After discovery of these different performance characteristics, analysis for chemical characteristics has provided a theory that the supplier's proprietary process, using methyl isobutyl ketone (MIBK) solvent and a final step adding 1 to 2 percent emulsifier of sodium lauryl sulfate and possibly Triton X-100 surfactant, creates over 20 percent dimer and about 3 to 6 percent free fluoroalcohol in the fluorocarbon pyromellitate product. Previously only small amounts of dimer were suspected in the product.

Speculation is that the use of MIBK solvent and different conditions creates more dimer.

The product supplied by the proprietary process is used as described in U.S. Pat. No. 4,192,754 above wherein the product is the "first noncontinuous phase". The resulting finish is applied as a conventional spin finish.

NMR (nuclear magnetic resonance spectroscopy) analysis confirms that the structure is the dimers of this invention (III), and is present in an amount of about 10 to 20 percent of the fluorocarbon compounds. Previously high performance liquid chromatography and size exclusion chromatography had shown presence of new higher molecular weight components in the product fluorocarbon pyromellitate from one supplier. The inventors, before that, discovered the product from this supplier had changed to consistently higher (better) oil resistance rating (by the technique of A.A.T.C.C. Test No. 118-1975), see U.S. Pat. No. 4,192,754 above, than previous product and better than product from another supplier, as shown in Tables I and II. The high dimer content material was first knowingly introduced in September, 1981.

TABLE I

| Month | Average Rating |
|---|---|
| August | 4.40 |
| September | 4.70 |
| October | 4.95 |
| November | 5.26 |
| December through 14th | 5.10 |

Also, during processing of yarn coated with a finish (described above) containing the composition of this invention, the crimp level of the yarn processed as disclosed in U.S. Pat. Nos. 3,266,082 and 4,095,318 both hereby incorporated by reference surprisingly had a higher crimp level, 11 crimps per inch (cpi) as opposed to the previous 10 cpi. Adjustment of the draw rollers back to 10 cpi allowed the speed of the initial or nip rolls to be reduced from about 245 to about 207 rpm which is more easily controllable. Also the pressure on the hinged outlet flap of the crimp box was lowered from about 48 to about 25 psig, also more easily controlled and a less harsh treatment of yarn.

After inventors' discoveries of different properties, the supplier was contacted and furnished the following data in Table II regarding retention of the fluorocarbon product on fabric. Inventors discovered that lots 8, 11 and 12 contain high percentages of dimer. The other lots are comparative.

TABLE II

| Lot | Initial (PPM-F)* | After Washing (PPM-F)** | Percent Fluorine Retained |
|---|---|---|---|
| 2 | 1,220 | 300 | 24.65 |
| (prior art) | 890 | 220 | |
| 7 | 1,150 | 380 | 33.00 |
| (prior art) | | | |
| 8 | 1,350 | 560 | 43.16 |
| | 1,240 | 530 | |
| | 1,270 | 520 | |
| | 1,180 | 540 | |
| | 1,070 | 480 | |
| 9 | 1,190 | 450 | 38.9 |
| (prior art) | 1,150 | 460 | |
| 10 | 1,250 | 510 | 40.8 |
| (prior art) | | | |
| 11 | 1,110 | 490 | 43.05 |
| | 880 | 370 | |
| 12 | 1,060 | 520 | 48.25 |
| | 950 | 450 | |
| another | 1,340 | 270 | 23.8 |
| prior art | 1,010 | 260 | |
| product | 1,170 | 300 | |

*Parts per million of fluorine.
**Standard A.A.T.C.C. home wash tumble dry durability test.

We claim:

1. A composition of matter comprising 90 to 50 percent by weight of fluorocarbon compounds of a mixture of meta and para pyromellitates having the structure

I.

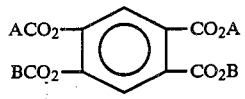

and

II.

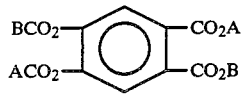

and 10 to 50 percent by weight of fluorocarbon compounds of a dimer of the same pyromellitates selected from the group consisting of

III.

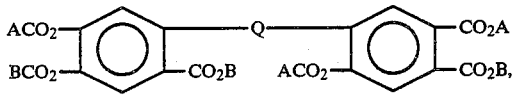

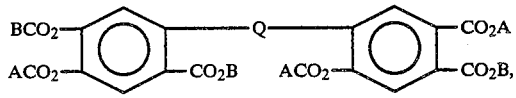

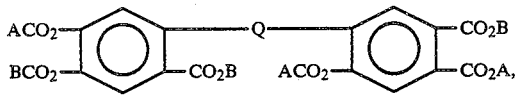

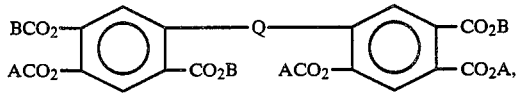

-continued

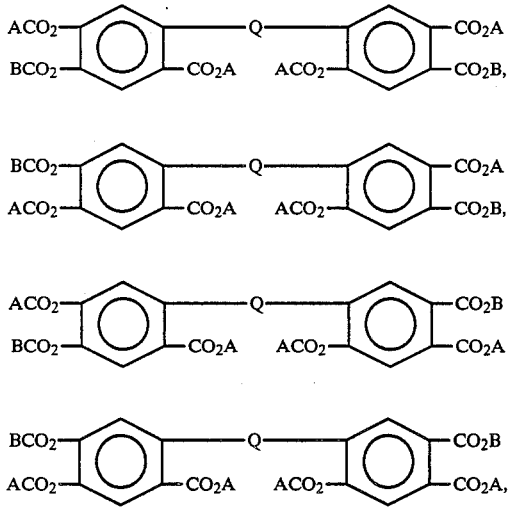

and mixtures thereof, wherein Q is

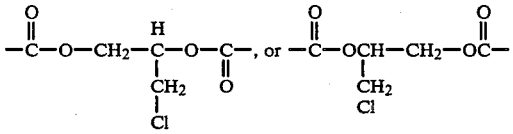

wherein A is $(CH_2)_2(CF_2)_nCF_3$ where n is 5 to 13 and B is $CH_2CHOHCH_2Cl$, and/or

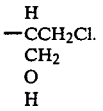

2. The composition of claim 1 in an emulsion.
3. A yarn finish containing the emulsion of claim 2.
4. Yarn coated with the finish of claim 3.
5. The yarn of claim 4 wherein the yarn is nylon.
6. The yarn of claim 4 wherein the yarn is polyester.
7. A yarn finish composition comprising
   a. about 15 to 80 weight percent of a solution of a salt of dioctyl sulfosuccinate, propylene glycol and water,
   b. the composition of claim 1.
8. Yarn coated with the finish of claim 7.
9. The yarn of claim 8 wherein the yarn is nylon.
10. The yarn of claim 8 wherein the yarn is polyester.
11. A yarn finish containing the composition of claim 1.
12. Yarn coated with the finish of claim 11.
13. The yarn of claim 12 wherein the yarn is nylon.
14. The yarn of claim 12 wherein the yarn is polyester.
15. Yarn containing the composition of claim 1.
16. Yarn of claim 15 wherein the yarn is nylon.
17. Yarn of claim 15 wherein the yarn is polyester.

* * * * *